US006022023A

United States Patent [19]

Ford, Jr.

[11] Patent Number: 6,022,023

[45] Date of Patent: Feb. 8, 2000

[54] APPARATUS AND METHOD OF PLAYING A BASKETBALL CARD GAME

[76] Inventor: Wallace J. Ford, Jr., 5524 Hadfield St., Philadelphia, Pa. 19143

[21] Appl. No.: 09/128,942

[22] Filed: Aug. 5, 1998

[51] Int. Cl.[7] ..... A63F 1/00

[52] U.S. Cl. ..... 273/298

[58] Field of Search ..... 273/298, 244, 273/259, 277, 247

[56] References Cited

U.S. PATENT DOCUMENTS

| | | | |
|---|---|---|---|
| 3,545,763 | 12/1970 | Seitz | 273/244 |
| 3,941,386 | 3/1976 | Nelson | 273/244 |
| 5,749,581 | 5/1998 | Poisson | 273/244 |

*Primary Examiner*—Benjamin H. Layno

*Attorney, Agent, or Firm*—Caesar, Rivise, Bernstein, Cohen & Pokotilow, Ltd.

[57] ABSTRACT

A basketball card game that simulates a real action basketball game including blocked shots, slam-dunks, fast breaks, steals, time-outs and free-throws. Each player or team is given a plurality of offensive and defensive cards along with time-out cards and quarter cards. A coin toss determines which team starts out playing offense. The team on offense draws one of their offensive cards, and if necessary, the defensive team draws a defensive card in hopes of counteracting the offensive play. Once all the offensive cards have been played, the quarter is over. The game consists of four quarters. At the end of the fourth quarter, the player or team with the highest combined score (of all four quarters) is the winner. The players can employ strategy by skillful use of the time-out cards and quarter cards to change the flow of the game or end a quarter.

24 Claims, 15 Drawing Sheets

82

84

APPARATUS AND METHOD OF PLAYING A BASKETBALL CARD GAME

FIELD OF THE INVENTION

The invention relates generally to games. More specifically, the invention relates to a basketball card game that captures the excitement, vivacity and in-your-face attitude found in the game of basketball.

BACKGROUND OF INVENTION

Basketball, whether played in the gym, neighborhood playground, or backyard hoop, is a game filled with intense exhilaration, thrill, agitation, and energy. The action is usually fast and animated. Basketball, though a team sport, allows individuals to express themselves in often creative ways. Basketball provides the opportunity for young (and not-so-young) men and women to compete with and, if skillful enough, to humiliate their friends and foes though dynamic displays of agility and mastery on the basketball court. Competitors who feel superior to their opponent can often be heard telling a potential victim "you can't check me." This phrase is known as both a warning and a challenge, a phrase telling the opponent, in essence, "you can't stop me from scoring."

The attitude and style of basketball makes it extremely difficult to capture, in a card game, the, fun, titillation, and savior faire experienced by the players of the game. The basketball card game of the present invention incorporates the excitement, thrill, fervor, and attitude displayed by basketball players of all ages and abilities. The game of the present invention has blocked shots, three pointers, steals, finger-rolls, slam-dunks, rejections, spin-moves, reverse dunks, and fast breaks, just to name a few. In addition, the game allows the players to use strategy in calling time-outs or using the quarter cards. Talking trash and blurting out "you can't check me" is encouraged. The object of the basketball card game, as in the real game played on the court, is to have the highest score at the end of the game. The cards depict, in vivid detail, the action taking place. For instance, the slam-dunk card illustrates a basketball player about to seriously slam a basketball through the hoop (with attitude). The basketball card game of the present invention simulates the game of basketball with all its exciting and breathtaking moments for persons of all ages and abilities to play. There is, therefore, a need for a basketball card game that captures the excitement, attitude and fast-paced-action of basketball. The present invention provides such a device.

OBJECTS OF THE INVENTION

Accordingly, it is a principal object of the invention to provide a basketball card game which captures the fun, excitement and attitude of the game of basketball.

It is another object of the invention to provide a basketball card game which uses cards to determine and display elements of the game of basketball including blocked shots, slam-dunks, free-throws, finger-rolls and fast breaks.

It is a further object of the invention to provide a basketball card game which allows the players to call time-out by use of time-out cards.

Still another object of the invention is to provide a basketball card game wherein a plurality of offense and defense cards are drawn by the players to determine scoring.

It is again an object of the invention to provide a basketball card game where the coin toss determines which player or team starts on offense.

Yet another object of the invention is to provide a basketball card game wherein the cards have drawings thereupon which illustrate the action written on the card.

It is an object of the invention to provide improved elements and arrangements thereof in an apparatus for the purposes described which is inexpensive, dependable and fully effective in accomplishing its intended purposes.

These and other objects of the present invention will become readily apparatus upon further review of the following specification and drawings.

SUMMARY OF THE INVENTION

These and other objects of the instant invention are achieved by providing a basketball card game apparatus for use with two teams. The apparatus comprises a plurality of offense cards, wherein each offense card comprises a unique offensive play in basketball; a plurality of defense cards, wherein each defense card comprises a unique defensive play in basketball; a plurality of quarter cards, wherein each quarter card permits a team to end a quarter of the basketball game at will; a plurality of time out cards, wherein each time out card permits the teams to exchange offense or defense cards or both. The plurality of offense cards are split into a first set for one team and into a second set for the other team. The plurality of defense cards are split into a third set for the first team and a fourth set for the other team. The teams alternate the use of the respective sets of offense and defense cards in response to one another. The teams introduce the respective quarter cards and time out cards at will.

These and other objects of the instant invention are also achieved by providing a method for playing a basketball card game between two teams wherein the method for playing comprises the steps of: (a) providing a first set and a second set of offense cards to each of the teams respectively, wherein each of the offense cards comprises a unique basketball offense play; (b) providing a third set and a fourth set of defense cards to each of the teams respectively, wherein each of the defense cards comprises a unique basketball defense play; (c) selecting a first team to move; (d) the first team selecting an offense card from the first set to initiate the basketball game; (e) the second team selecting a defense card from the fourth set to respond to the first team's selecting an offense card from the first set; (f) the first team and the second team selecting from their respective sets of offense cards and defense cards in alternation and in response to each other teams's cards to play a basketball game until the first set and second set of offense cards are depleted, thereby ending a quarter; and (g) tracking points for each of the first and second teams during the alternation.

DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 9:
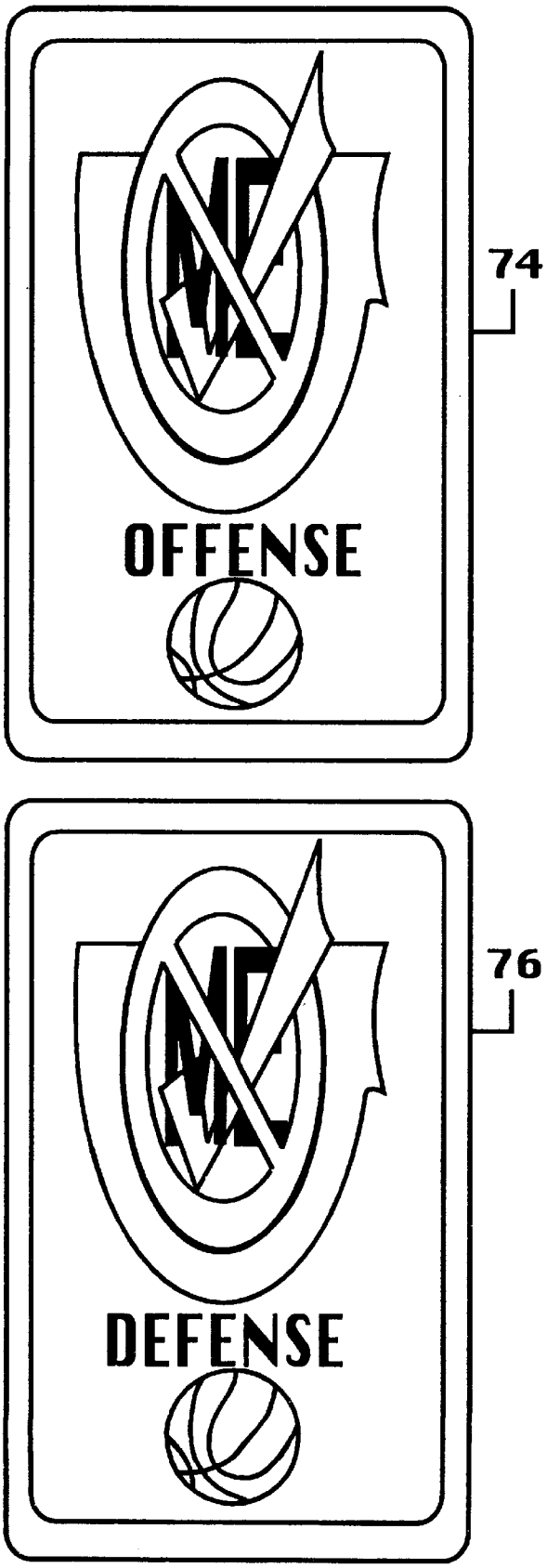
FIG. 9 is a top view showing the back side of an offense card and the back side of a defense card.

The invention relates to a basketball card game wherein a real action basketball game is simulated in a game utilizing cards including blocked shot cards, slam-dunk cards, fast break cards, lay-up cards, timeout cards, and free-throw cards. Each player or team is given a number of offense and defense cards along with time out cards and quarter cards. Table 1 lists the different offense and defense cards and the quantity of each used in the game. When positioned face down, the back 74 of each offense card and the back 76 of each defense card is as shown in FIG. 9.

Figure 15:
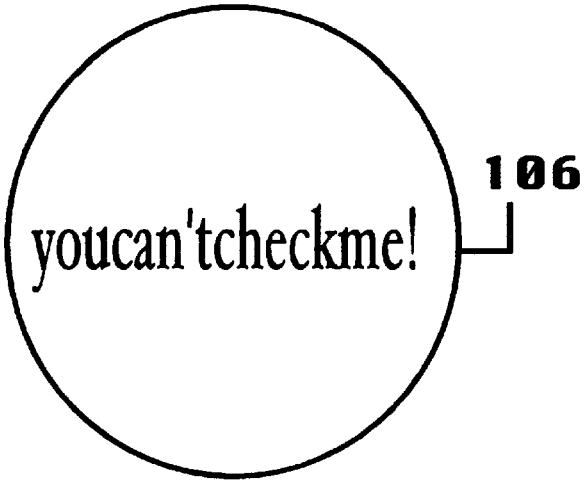
FIG. 15 is an enlarged top view showing the front side and the back side of a coin included with the game.
Figure 15:
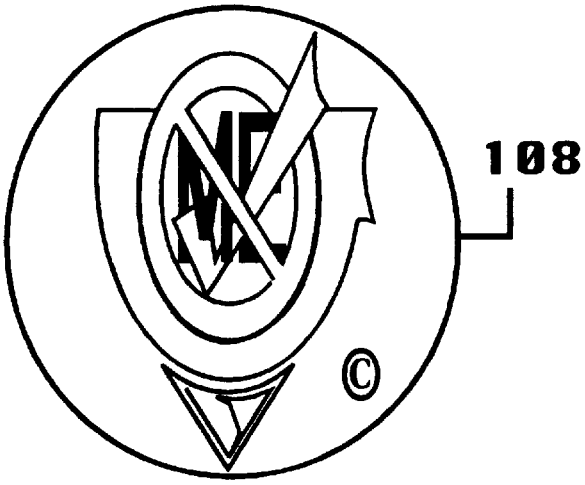

The game includes a box (not shown) for housing all of the game elements: offense cards, defense cards, four card trays, score sheets and a first-move team selection means for determining who is to be the team to move first; it should be understood that where such a selection means is accomplished by, for example, a coin toss or drawing a higher card from a conventional card deck, the selection means is not included in the game box since these items may be readily available to the players. Alternatively, as shown in FIG. 15, the game box may also include a specialized coin having a front side 106 and a back side 108 that can be used for selecting which team goes first.

In general, the team on offense draws one of their offense cards (which will be discussed in detail later) and if necessary, the defense team draws a defense card (which will also be discussed in detail later) to defend against the offense play. The quarter is over once all the offense cards have been played. The game consists of four quarters at the end of which the player or team with the highest combined score (of all four quarters) is the winner. The team or player with the highest score at the end of the quarter loses a quarter card. The players can employ strategy by skillfully using the time-out cards and quarter cards to change the flow of the game or end a quarter.

Figure 1:
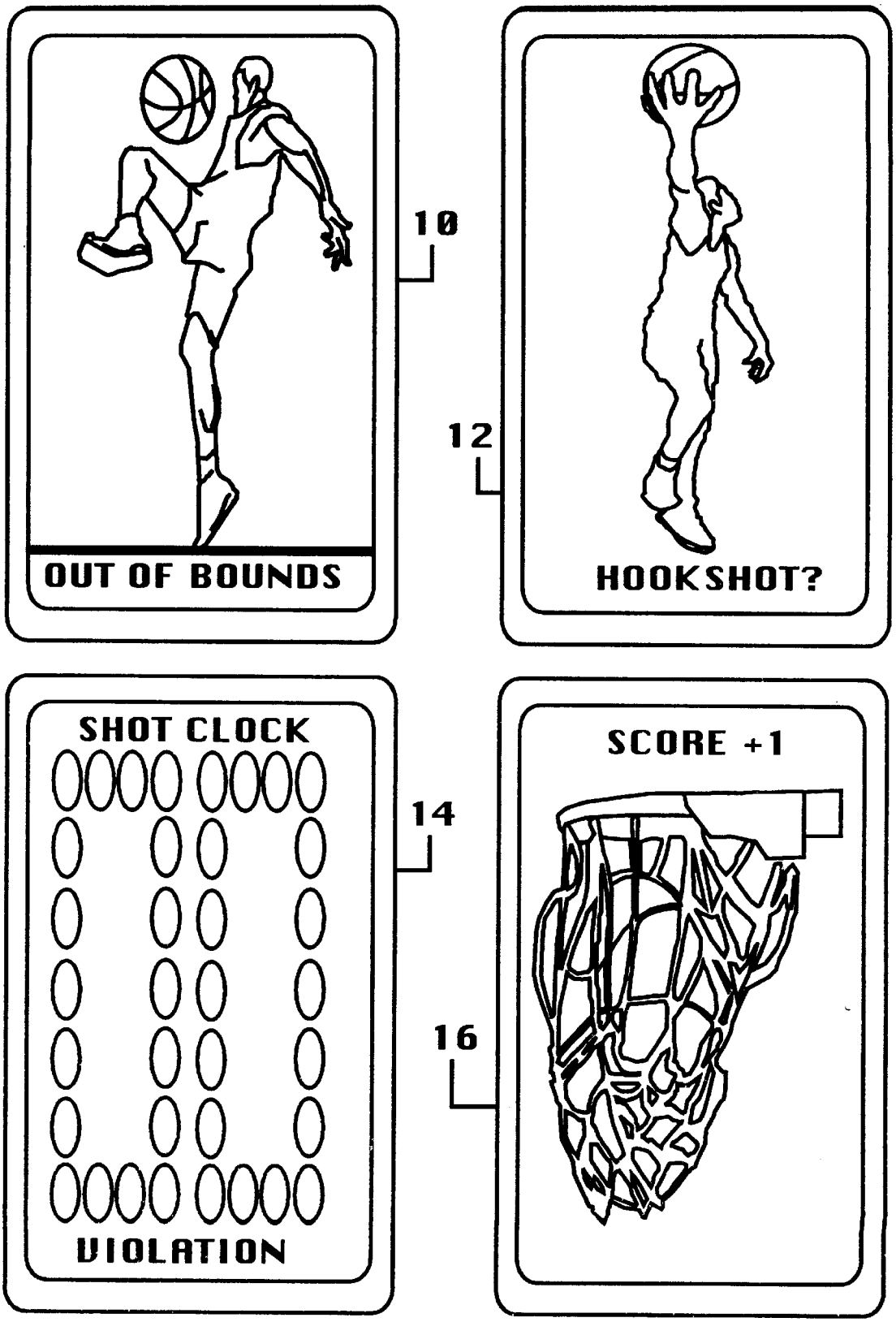
FIG. 1 is a top view showing an out-of-bounds card, hook shot, shot clock and a score card.
Figure 2:
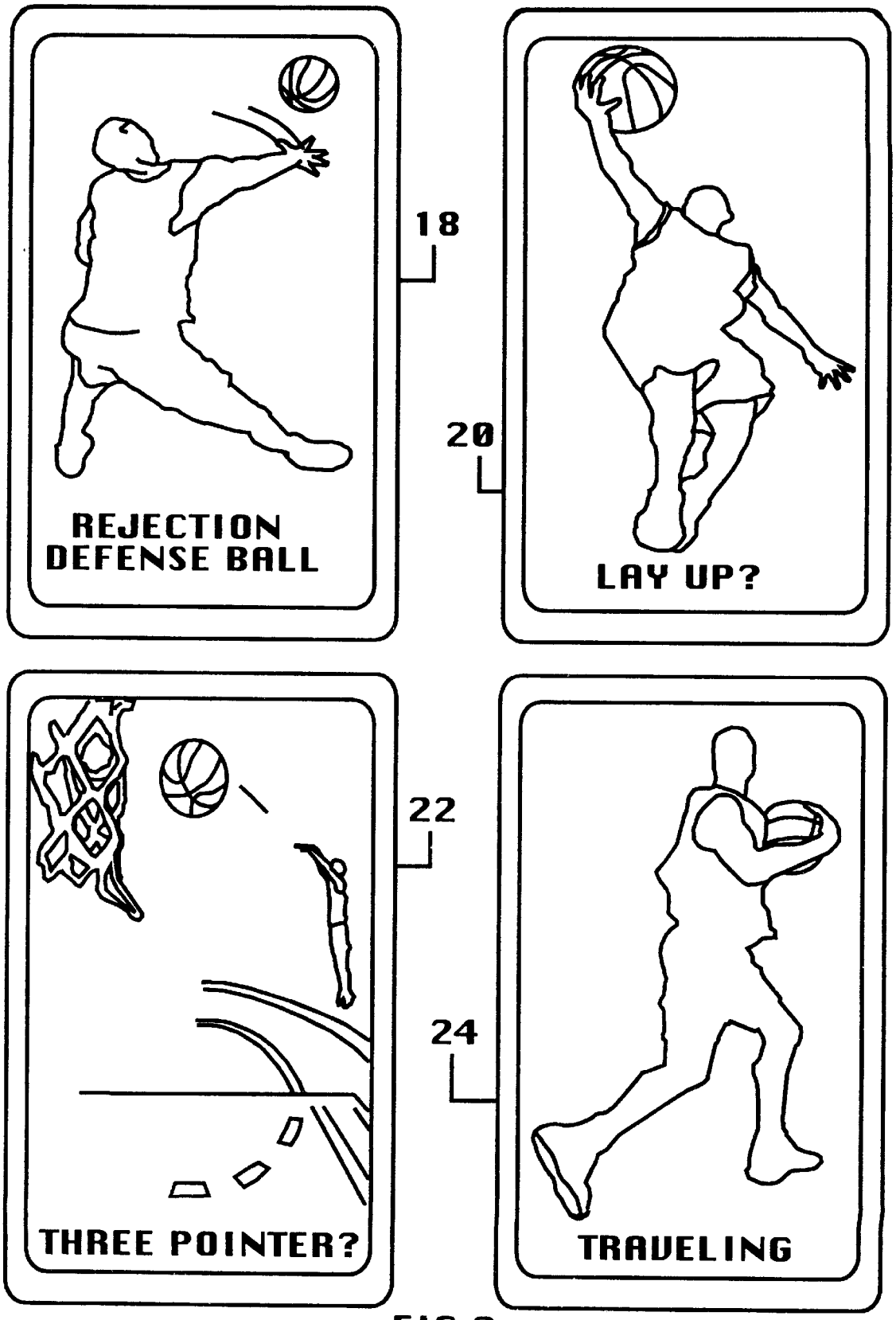
FIG. 2 is a top view showing a rejection, lay-up, three pointer, and traveling card.
Figure 3:
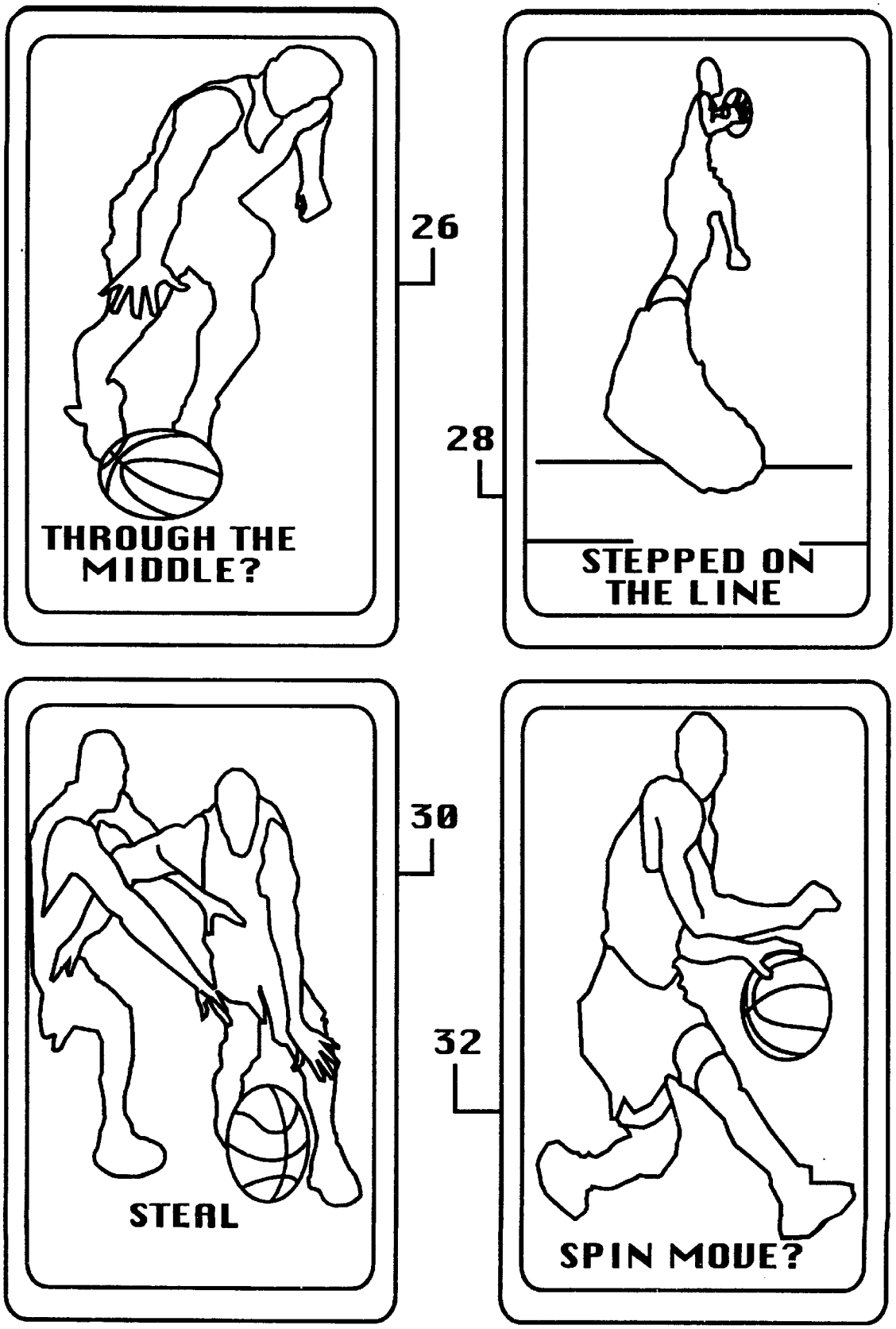
FIG. 3 is a top view showing a through the middle, stepped on the line, steal and spin move card.
Figure 4:
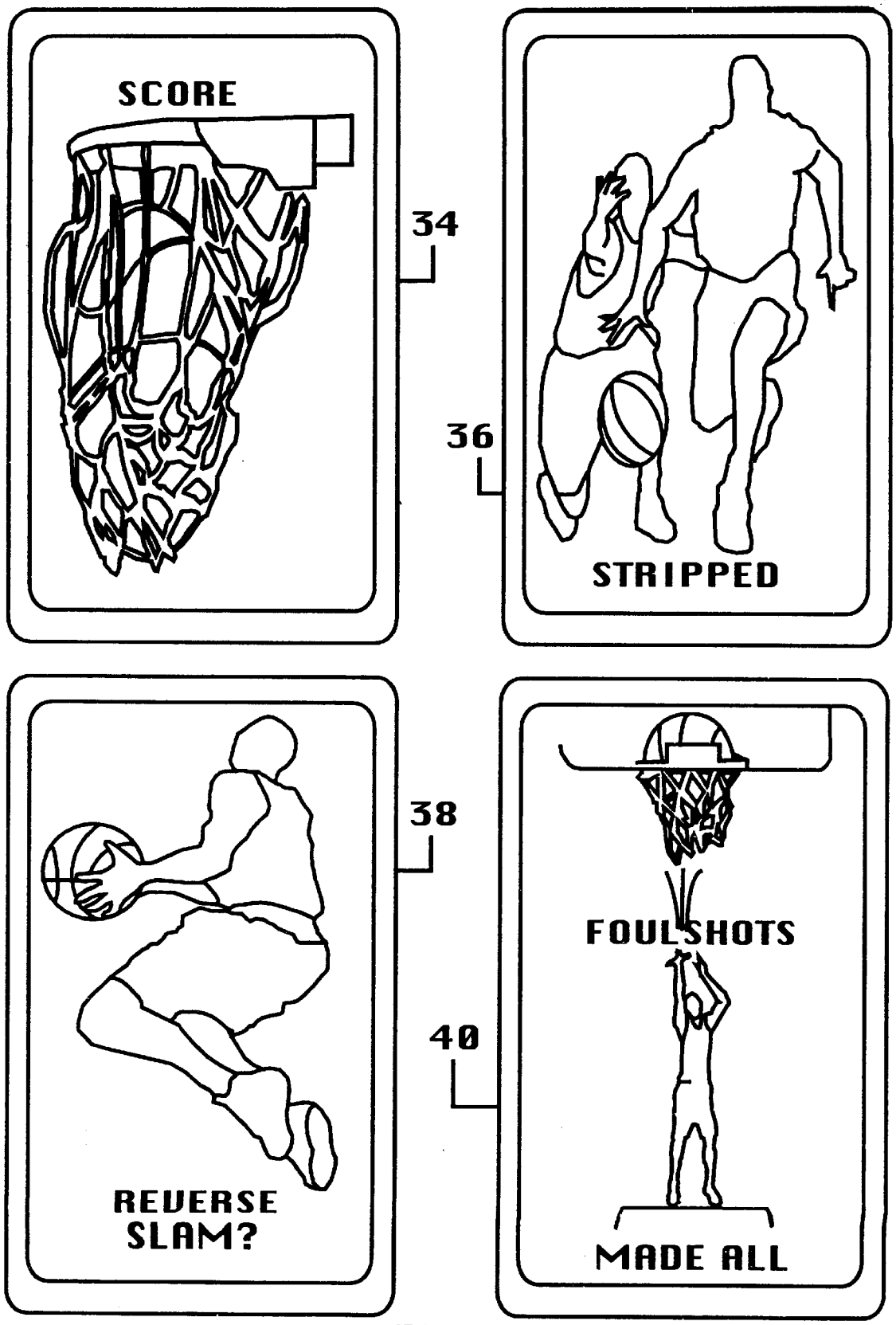
FIG. 4 is a top view showing a score, stripped, reverse dunk and a foul shot card.
Figure 5:
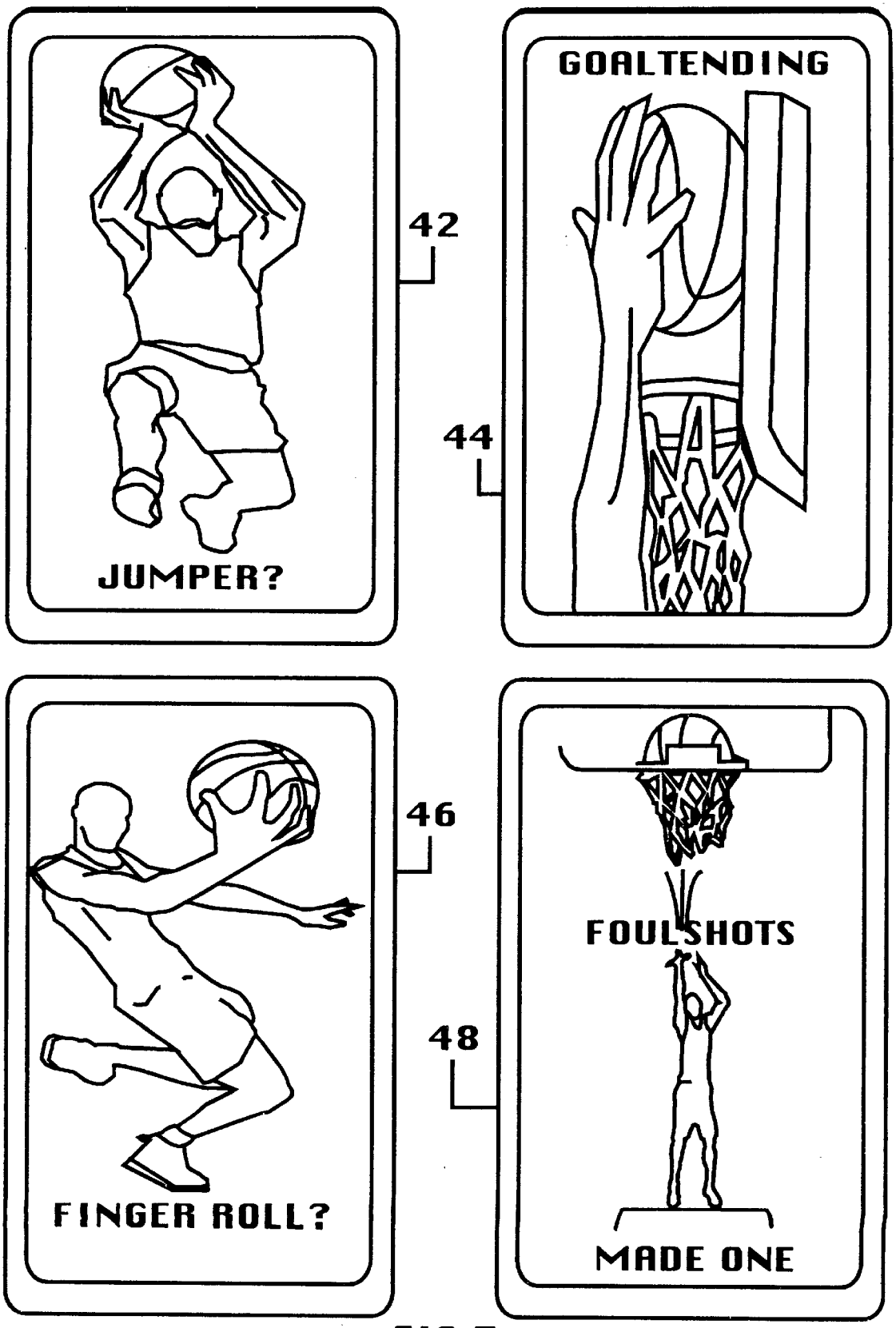
FIG. 5 is a top view showing a jumper, goal tending, finger role and foul shot card.
Figure 6:
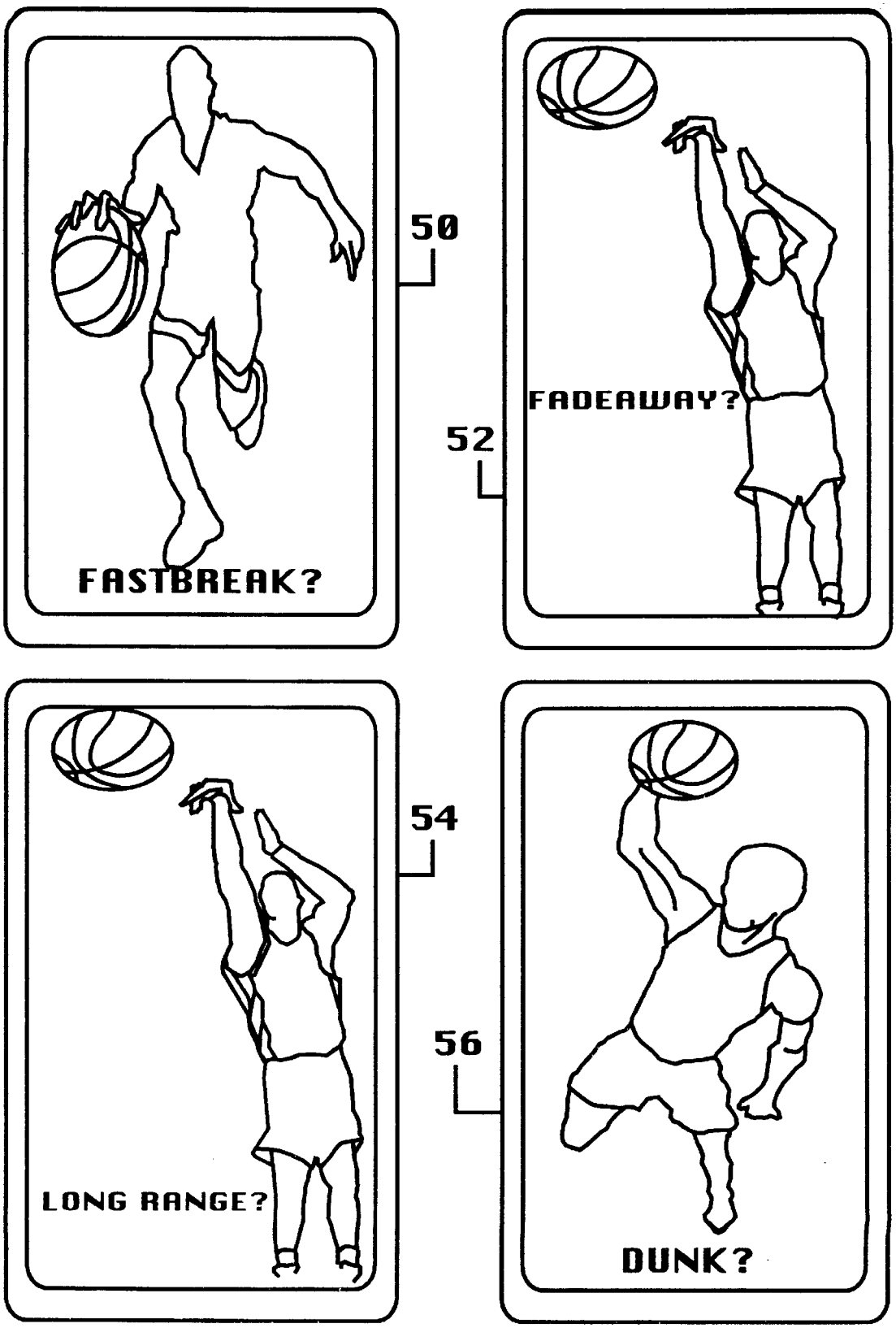
FIG. 6 is a top view showing a fastbreak, fade-a-way, long-range, and dunk card.
Figure 7:
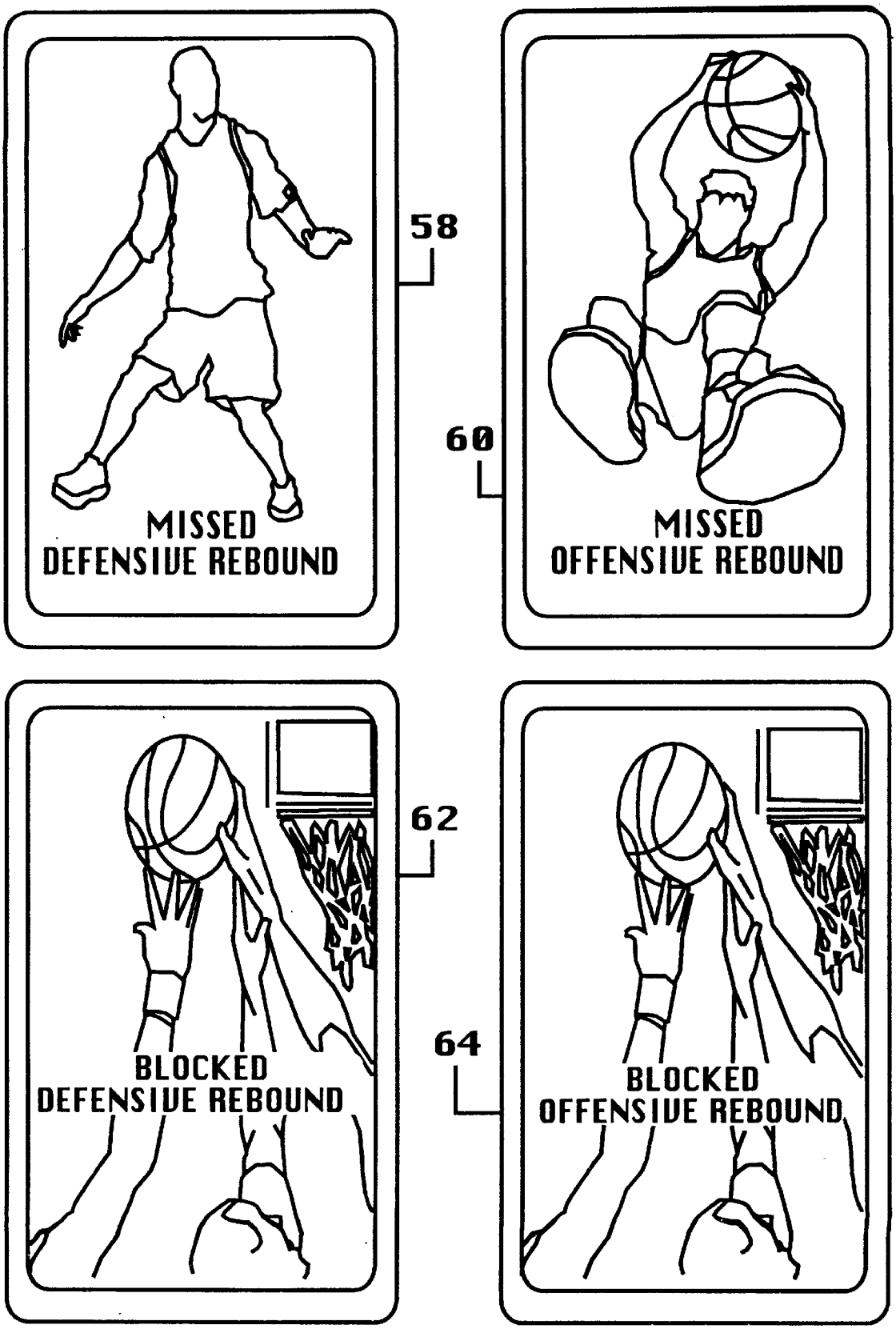
FIG. 7 is a top view showing a defensive rebound, offensive rebound, and two blocked shot cards.
Figure 8:
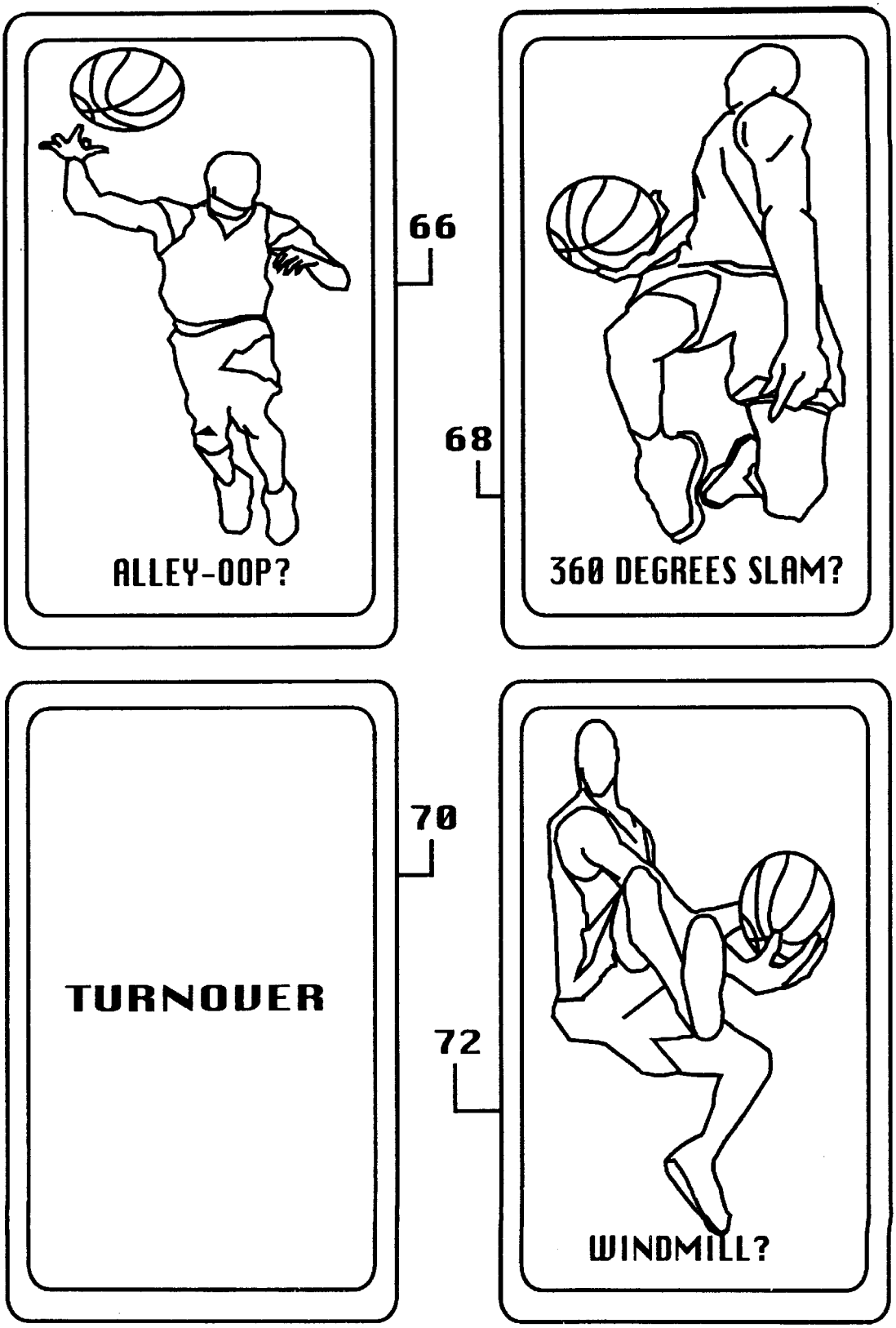
FIG. 8 is a top view showing an alley-oop, 360 degree slam, turnover and windmill card.
Figure 10:
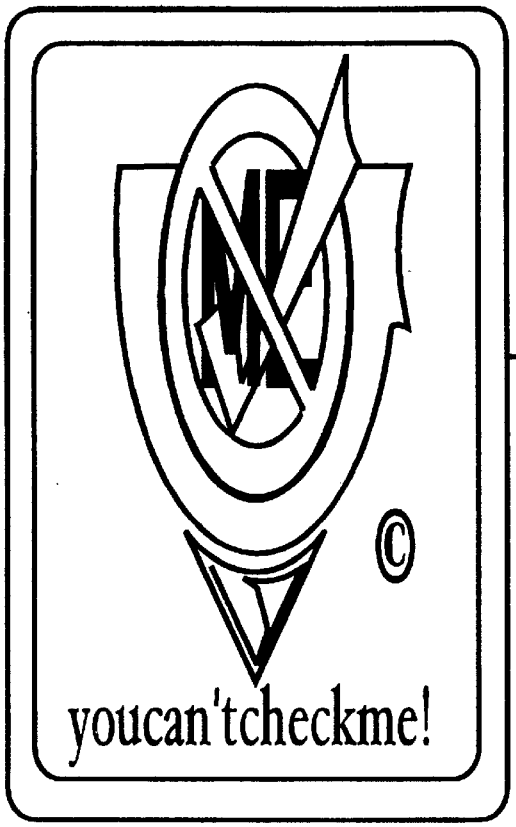
FIG. 10 is a top view showing the front side and the back side of a quarter card.
Figure 10:
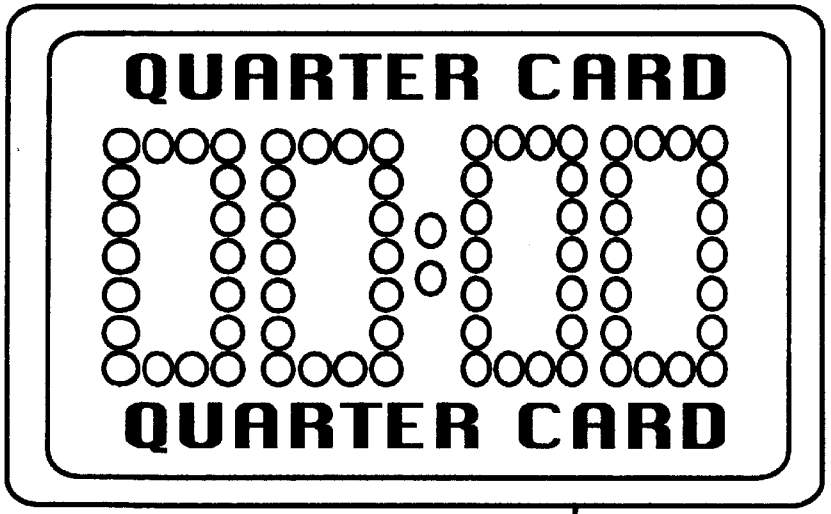
Figure 11:
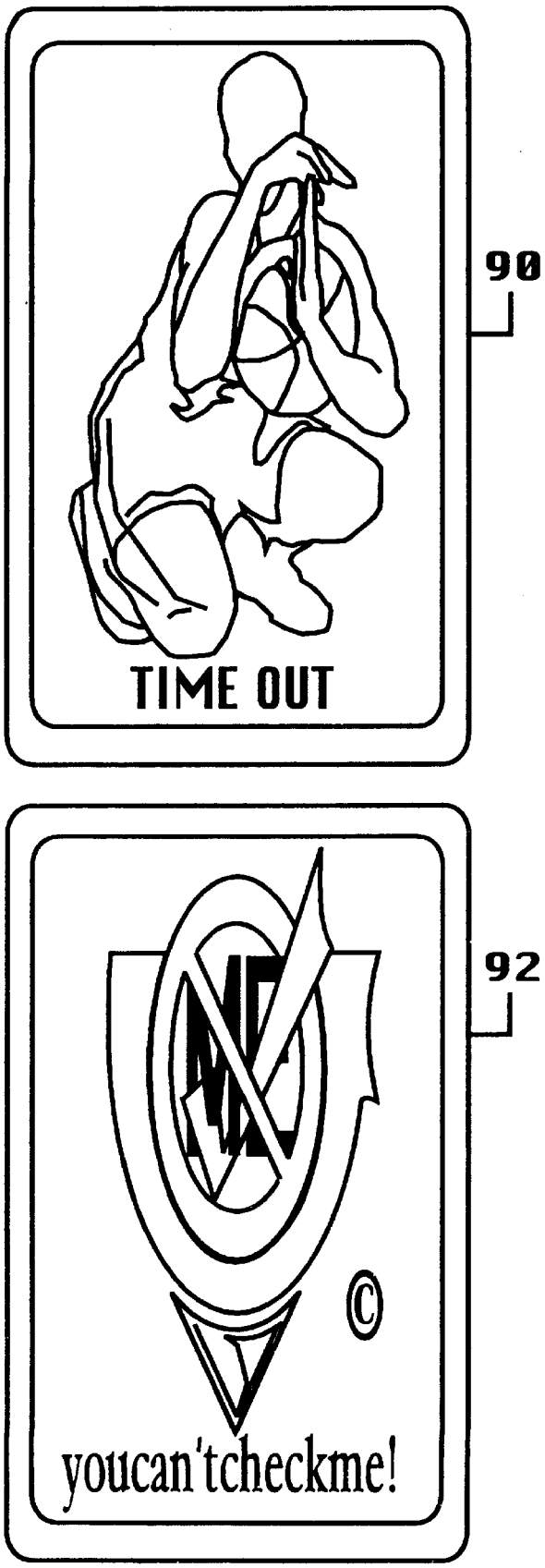
FIG. 11 is a top view showing the front side and the back side of a time out card.
Figure 12:
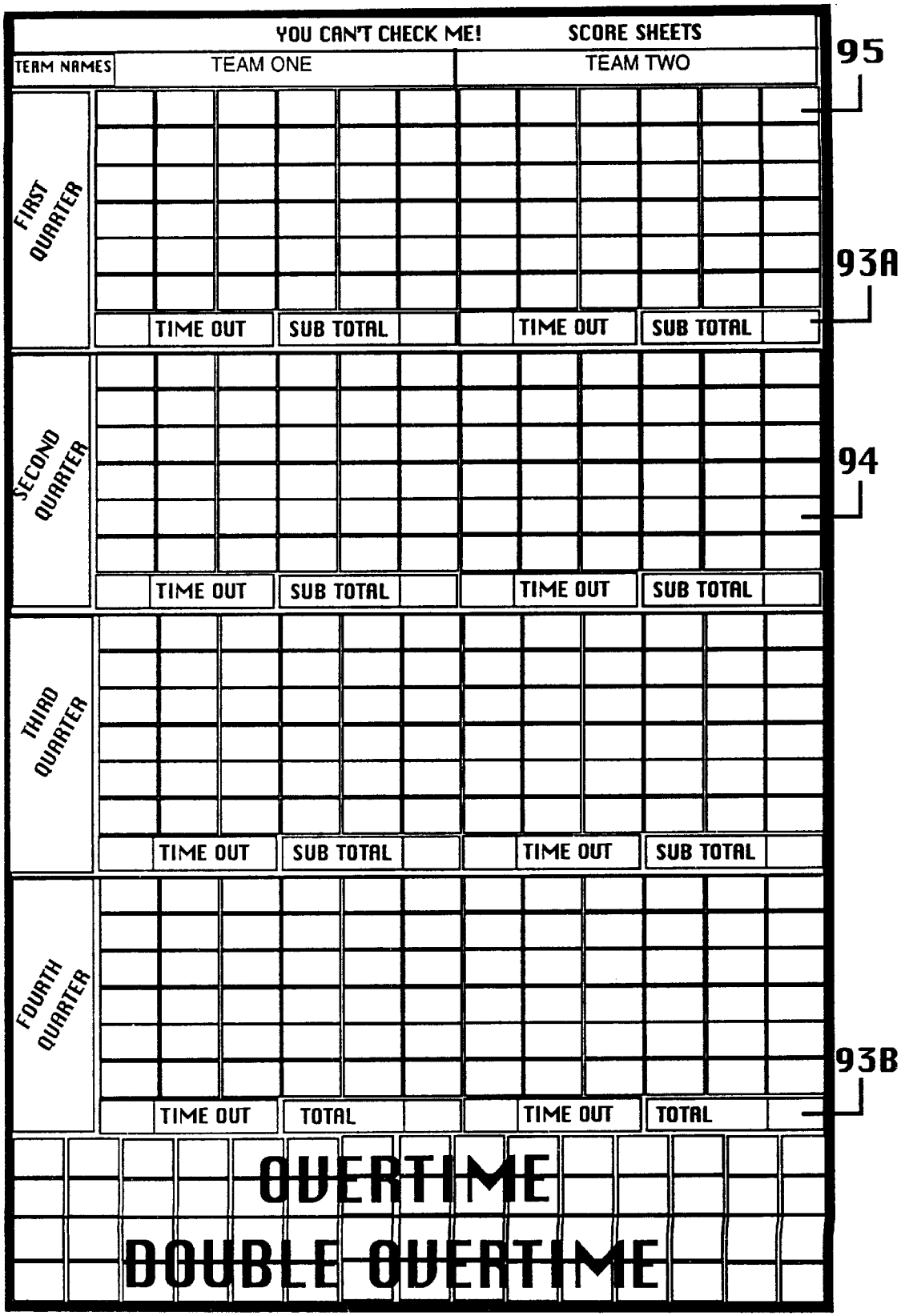
FIG. 12 is a top view showing the score sheet.

Turning now to FIG. 1 of the drawings, out of bounds card 10, hook shot card 12, shot clock violation card 14 and score +1 card 16 are illustrated. FIG. 2 illustrates rejection card 18, lay-up card 20, three-pointer card 22 and traveling card 24. FIG. 3 illustrates through-the-middle card 26, stepped-on-the-line card 28, steal card 30, and spin move card 32. FIG. 4 illustrates score card 34, stripped card 36, reverse dunk card 38, and foul shots (made all) card 40. FIG. 5 illustrates jumper card 42, goal tending card 44, finger-role card 46, and foul shots (made 1) card 48. FIG. 6 illustrates fastbreak card 50, fade-a-way card 52, long-range card 54, and slam-dunk card 56. FIG. 7 illustrates missed shot defense rebound card 58, missed shot offense rebound card 60, blocked shot offense rebound card 62, and blocked shot defense rebound card 64. FIG. 8 illustrates alley-oop card 66, 360 degrees slam dunk card 68, turnover card 70 and windmill card 72. FIG. 9 illustrates the back 74 of the offense cards and the back 76 of the defense cards. FIG. 10 illustrates the back 82 of the quarter card and the front 84 of the quarter card. FIG. 11 illustrates the front 90 of the time out card and the back 92 of the time out card. The score sheet 94 is illustrated in FIG. 12.

Figure 13:
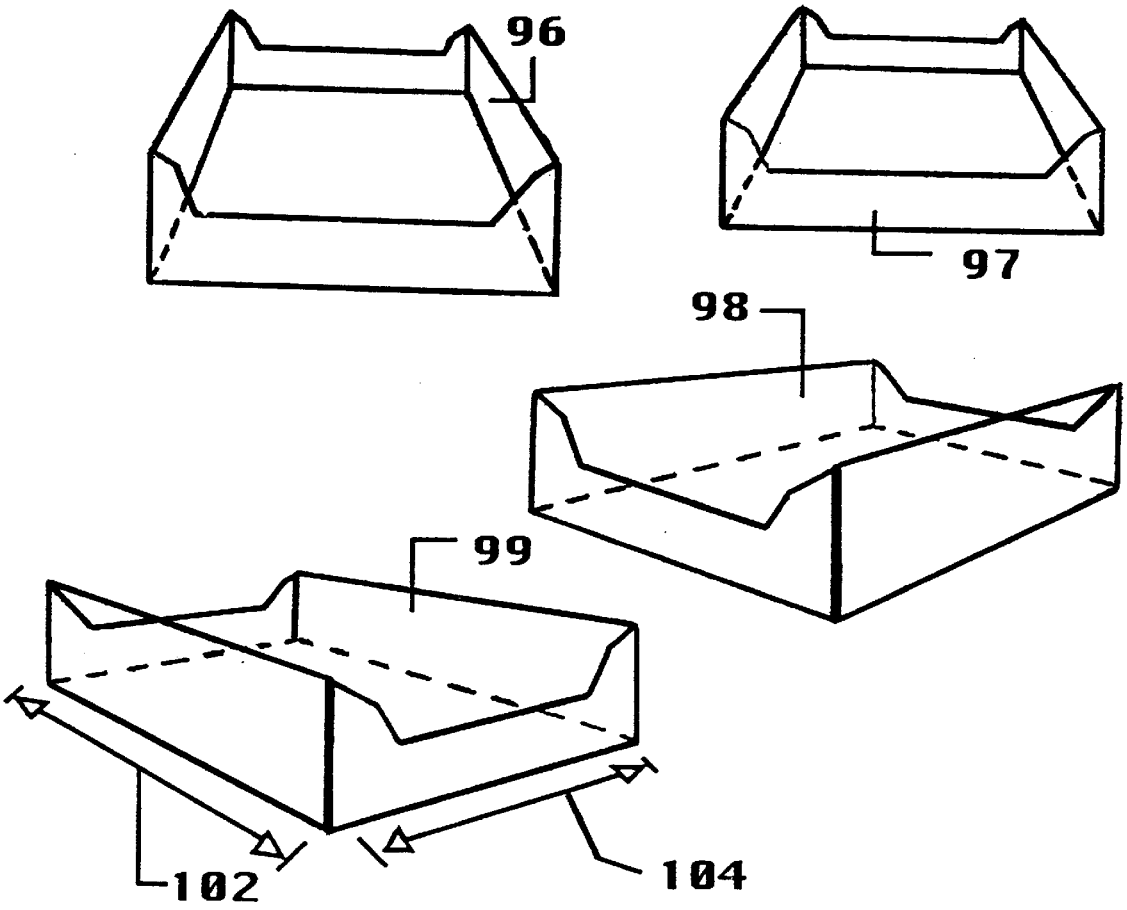
FIG. 13 is a perspective view of each of the four card trays.
Figure 14:
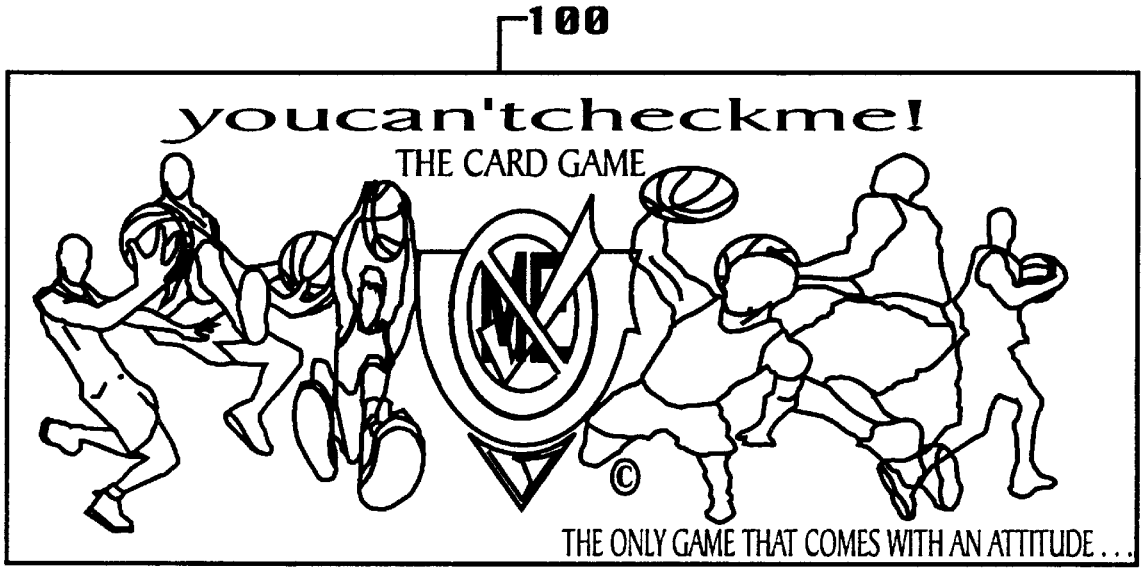
FIG. 14 is a top view of the game box top.

The game includes four cards trays 96, 97, 98 and 99 as illustrated in FIG. 13 for holding each team's offense cards and defense cards, respectively, hence a total of four trays. Each card tray is dimensioned to receive the offense and defense cards; as can be seen in FIG. 13, the length 102 of the tray is approximately 4.75 inches and the width 104 of the tray is approximately 3.25 inches. FIG. 14 depicts the decorative box top 100 of the game which provides a unique descriptive cover for the game elements.

To begin play, each player picks a team name, either a name belonging to a professional team, local school, city, or a uniquely-creative name. The players then evenly divide the offense and defense cards and place them in respective card trays 96 and 97 (FIG. 13), facing down. Each player receives one time-out card (FIG. 11) and two quarter cards (FIG. 10). Next, if there are teammates, the teammates at this time determine who will play the offense deck and who will play the defense deck.

A first-move selection means is then used to determine who will be the first team to move. The preferable means is a coin toss but it should be understood that other types of offense team-selection means are within the broadest scope of this invention such as a higher card draw of a conventional card deck, a lot selection, etc. The following discussion assumes a coin toss but it is only exemplary. The coin is then tossed and the team or player who correctly calls the side of the coin that lands face up goes first (i.e., is on offense first). The team or player that wins the toss will be team 1 or player 1. Team 2 or player 2 (the loser(s) of the toss) keeps score (although an alternate or third person can be named the score keeper). The score keeper then writes the name of the team on the score sheet 94 (FIG. 12).

Team 1 now draws from their own offense deck (note: all cards in the offense and defense decks must remain face down). If the drawn card calls for a defense card to be drawn then team 2 draws from the defense deck to determine the results of team 1's offense play. For example, if team 1 draws offense card 50 (FIG. 6, fastbreak) and team 2 draws defense card 64 (FIG. 7, blocked, defense rebound) then team 2 now has possession of the ball and must draw an offense card. The game continues at this pace until all of the offense cards have been drawn. If one team depletes all of their offense cards before the other team, then the remaining offense cards will be split among the teams. The quarter has ended when all of the offense cards have be drawn. The score is then tallied for each team. The team with the highest score loses one quarter card. All offensive cards are combined, shuffled and evenly divided among the two teams. Likewise, all the defense cards are combined, shuffled and evenly divided. Play then continues onto the next quarter. The team with the highest combined score at the conclusion of four quarters is the winner.

Team 2 or the alternate score keeper monitors or keeps track of the score and when time out cards 90 are used. The scorer uses score sheet 94 (FIG. 12) to mark or record the total number of points for each play. The points are recorded in the small blocks 95 of score sheet 94. At the end of the quarter the score keeper adds the total points and records the score for that quarter in small block 93A. At the end of the fourth quarter, the combined points are added and recorded in small block 93B.

In the event of a tie game, overtime will be played. The offense and defense cards are reshuffled and distributed, plus one timeout card, another coin toss is made, and play resumes until all the offense cards have been played. The score from the four quarters and overtime are combined. If the score is tied at the conclusion of overtime then the cards are shuffled again and a double overtime is played. This is repeated until there is a winner when all the offense cards have been played.

Throughout the game each player or team can use their one time-out card 90 and two quarter cards 84 strategically. The time-out cards 90 can be used at any time during the game to change the course of the game. When a team uses a time-out card 90, that team can exchange their pile of offense or defense cards or both with their opponent. However, each team can only use a time-out card 90 once during a quarter. Each team can use their quarter cards 84 twice during a game. When a team uses a quarter card 84, the quarter is over at that point.

The offense cards include out-of-bounds 10, hook shot 12, shot-clock 14, lay-up 20, three-pointer 22, traveling 24, through-the-middle 26, stepped-on-the-line 28, spin move 32, reverse dunk 38, jumper 42, finger-role 46, fastbreak 50, fade-a-way 52, long-range 54, dunk 56, alley-oop 66, 360 degree slam 68, turnover 70 and windmill 72.

The defense cards include out-of-bounds 10, shot clock violation 14, score +1 16, rejection 18, traveling 24, stepped-on-the-line 28, steal 30, score 34, stripped 36, foul shots made all 40, goal-tending 44, foul shots made 1 48, missed defensive rebound 58, missed offensive rebound 60, blocked offensive rebound 62, blocked defensive rebound 64, and turnover 70.

TABLE 1

| Type of Card | Offense | Defense |
|---|---|---|
| OUT OF BOUNDS | 2 | 5 |
| SHOT CLOCK VIOLATION | 4 | 4 |
| HOOKSHOT ? | 5 | |
| SCORE + 1 | | 8 |
| REJECTION | | 8 |
| LAY UP ? | 7 | |
| 3 POINTER ? | 6 | |
| TRAVELING | 2 | 5 |
| THROUGH THE MIDDLE ? | 7 | |
| STEPPED ON THE LINE | 2 | 5 |
| STEAL | | 9 |
| SPIN MOVE ? | 4 | |
| SCORE | | 30 |
| STRIPPED | | 8 |
| REVERSE DUNK ? | 5 | |
| FOULSHOTS/MADE ALL | | 6 |
| JUMPER ? | 10 | |
| GOAL TENDING | | 4 |
| FOULSHOTS/MADE 1 | | 10 |
| FINGERROLE ? | 7 | |
| FAST BREAK ? | 8 | |
| FADE AWAY ? | 3 | |
| LONGRANGE ? | 4 | |
| DUNK ? | 5 | |
| MISSED DEFENSIVE REBOUND | | 12 |

TABLE 1-continued

| Type of Card | Offense | Defense |
|---|---|---|
| MISSED OFFENSIVE REBOUND | | 12 |
| BLOCKED OFFENSIVE REBOUND | | 9 |
| BLOCKED DEFENSIVE REBOUND | | 9 |
| ALLEY OOP ? | 5 | |
| 360 DEGREES SLAM ? | 5 | |
| TURNOVER | 4 | 6 |
| WINDMILL ? | 5 | |

TIME OUT CARDS 2
QUARTER CARDS 4

I claim:

1. A basketball card game apparatus for use with two teams comprising:

a plurality of offense cards, wherein each offense card comprises a unique offensive play in basketball;

a plurality of defense cards, wherein each defense card comprises a unique defensive play in basketball;

a plurality of quarter cards, wherein each quarter card permits a team to end a quarter of the basketball game at will;

a plurality of time out cards, wherein each time out card permits the teams to exchange offense or defense cards or both; and said plurality of offense cards being split into a first set for one team and into a second set for the other team, said plurality of defense cards being split into a third set for said first team and a fourth set for said other team, said teams alternating the use of said respective sets of offense and defense cards in response to one another, said teams introducing said respective quarter cards and time out cards at will.

2. The apparatus of claim 1 further comprising a score sheet for tracking the scores of said teams.

3. The apparatus of claim 1 further comprising a plurality of trays, said trays being dimensioned and configured to contain said each of said first, second, third and fourth sets of cards, respectively.

4. The apparatus of claim 1 wherein said plurality of defense cards comprises a foulshots/made 1 card.

5. The apparatus of claim 1 wherein said plurality of defense cards comprises a foulshots/made all card.

6. The apparatus of claim 1 wherein said plurality of defense cards comprises a missed defensive rebound card and a missed offensive rebound card.

7. The apparatus of claim 1 wherein said plurality of defense cards comprises a blocked offensive rebound card and a blocked defensive rebound card.

8. The apparatus of claim 1 wherein said plurality of defense cards comprises a goal-tending card, a score card, a score+1 card and a turnover card.

9. The apparatus of claim 1 wherein said plurality of defense cards comprises a stripped card, a traveling card, a steal card and a stepped-on-the-line card.

10. The apparatus of claim 1 wherein said plurality of defense cards comprises a rejection card, a shot clock violation card and an out-of-bounds card.

11. The apparatus of claim 1 wherein said plurality of offense cards comprises a lay up card, a dunk card, a turnover card, a 3-pointer card, and a traveling card.

12. The apparatus of claim 1 wherein said plurality of offense cards comprises a hook shot card, a long-range card, and a jumper card.

13. The apparatus of claim 1 wherein said plurality of offense cards comprises a windmill card, a 360-degrees slam card and a fade-away card.

14. The apparatus of claim 1 wherein said plurality of offense cards comprises a fast-break card, a finger-role card and an alley-oop card.

15. The apparatus of claim 1 wherein said plurality of offense cards comprises a spin-move card, a through-the-middle card and a stepped-on-the-line card.

16. The apparatus of claim 1 wherein said plurality of offense cards comprises a shot-clock violation card, an out-of-bounds card and a reverse-dunk card.

17. The apparatus of claim 1 further comprising a first-move selection means.

18. A method for playing a basketball card game between two teams wherein the method of playing comprises the steps of:

(a) providing a plurality of offensive and defensive cards;

(b) dividing all of the offensive cards into a first set and a second set of offense cards and assigning one of said sets of offensive cards to each of said teams respectively, wherein each of said offense cards comprises a unique basketball offense play;

(c) dividing all of the defensive cards into a third set and a fourth set of defense cards and assigning one of said sets of defensive cards to each of said teams respectively, wherein each of said defense cards comprises a unique basketball defense play;

(d) selecting a first team to move;

(e) said first team selecting an offense card from said first set to initiate the basketball game;

(f) said second team selecting a defense card from said fourth set to respond to said first team's selecting an offense card from said first set;

(g) said first team and said second team selecting from their respective sets of offense cards and defense cards in alternation and in response to each other teams's cards to play a basketball game until said first set and second set of offense cards are depleted, thereby ending a quarter; and (h) tracking points for each of said first and second teams during said alternation.

19. The method of claim 18 further comprising the step of repeating steps a–h three times to conduct a total of four quarters and wherein the team having the highest point total after said four quarters is the winner of said basketball card game.

20. The method of claim 18 further comprising the step of providing each of said teams with a respective time out card, said time out card permitting said teams to exchange said first and second offense card sets with each other, said third and fourth card sets with each other, or both respective offense and defense cards with the other team's.

21. The method of claim 20 further comprising the step of providing each of said teams with two respective quarter cards, each of said quarter cards enabling a team to end a quarter whenever desired.

22. The method of claim 18 further comprising the steps of:

(a) splitting either said first set of offense cards or said second set of said offense cards whenever one of said sets is depleted; and (b) giving one half of said split first set or split second set to said team having depleted its set of offense cards.

23. The method of claim 18 wherein said step of selecting a first team to move comprises tossing a coin and correctly selecting the side that lands face up.

24. The method of claim 18 wherein said step of tracking the score comprises the use of a score sheet.

* * * * *